US006336577B1

(12) United States Patent
Harris et al.

(10) Patent No.: US 6,336,577 B1
(45) Date of Patent: Jan. 8, 2002

(54) BACKPACK COOLER

(75) Inventors: Lori Harris; Pat Harris, both of Kansas City, MO (US)

(73) Assignee: Cool Pac Products, Inc., Kansas City, MO (US)

( * ) Notice: Subject to any disclaimer, the term of this patent is extended or adjusted under 35 U.S.C. 154(b) by 0 days.

(21) Appl. No.: 09/591,238

(22) Filed: Jun. 9, 2000

(51) Int. Cl.[7] ..... B65D 30/02

(52) U.S. Cl. ..... 224/153; 224/652; 224/657; 383/110

(58) Field of Search ..... 224/153, 652, 224/657; 383/110

(56) References Cited

U.S. PATENT DOCUMENTS 4,537,313 A * 8/1985 Workman ..... 383/110
4,679,242 A * 7/1987 Brockhaus ..... 383/110
4,767,039 A * 8/1988 Jacober ..... 224/151
4,941,603 A * 7/1990 Creamer et al. ..... 224/148
5,090,526 A * 2/1992 Jacober ..... 190/107
5,562,228 A * 10/1996 Ericson ..... 383/110
5,573,166 A * 11/1996 Leja ..... 224/630
5,657,917 A * 8/1997 Johnson et al. ..... 224/582
5,743,447 A * 4/1998 McDermott ..... 224/153
5,857,778 A * 1/1999 Ells ..... 383/110
5,975,387 A * 11/1999 Gleason et al. ..... 224/148.2
6,015,072 A * 1/2000 Young ..... 224/153
6,068,402 A * 3/2000 Freese et al. ..... 383/110
6,193,118 B1 * 2/2001 Kearl ..... 224/153

* cited by examiner

*Primary Examiner*—Stephen P. Garbe
(74) *Attorney, Agent, or Firm*—Hovey, Williams, Timmons & Collins

(57) ABSTRACT

A backpack cooler (10) designed to be worn on the back of a person includes a flexible enclosure (12) having backpack straps (14) affixed to the enclosure (12). The enclosure includes front, rear, side and bottom walls (18–24) and an openable top panel (26). The walls (18–24) and panel (26) include an outer fabric layer (28), inner foil facing (30) and thermal insulation (32) between the layer (28) and facing (30). A flexible, water-impervious synthetic resin liner (54) is situated within the enclosure (12). The cooler (10) may be equipped with external pockets (58, 60, 67, 72).

13 Claims, 1 Drawing Sheet

BACKPACK COOLER

BACKGROUND OF THE INVENTION

1. Field of the Invention

The present invention is broadly concerned with a backpack cooler of a type which may be worn on the back of a person. More particularly, the invention pertains to such a backpack cooler which is thermally insulated and water-impervious, thereby allowing canned or bottled drinks or the like to be efficiently cooled by a coolant source while the weight of such drinks is easily carried owing to the backpack design.

2. Description of the Prior Art

Portable coolers of various shapes and sizes have long been available. These coolers can be formed of polyurethane foam materials, or hard synthetic resin materials which are thermally insulated. As any experienced picnicker or hiker will attest, the weight of a filled medium to large size cooler can be considerable. Thus, these coolers are not only unwieldy but the weight thereof precludes easy transport.

It has also been known in the past to provide coolers of flexible design which are typically of relatively small size and adapted to be hand carried. While these coolers ameliorate the weight problem, the small size thereof detracts from their usefulness.

SUMMARY OF THE INVENTION

The present invention overcomes the problems outlined above, and provides a backpack cooler which is designed to be worn on the back of a user. At the same time, the cooler is of sufficient size to accommodate a large supply of drinks or food to be cooled. Broadly speaking, the cooler of the invention comprises a flexible enclosure including front and rear walls, sidewalls, a bottom wall, and an openable top panel in order to afford access to the enclosure interior. The walls of the enclosure include an outer layer of fabric, an inner facing of heat reflective foil, and a thermal insulation layer between the outer fabric layer and foil facing.

In addition, a continuous, water-impervious liner is located within the enclosure and is secured to at least certain of the enclosure walls. The liner preferably is flexible and generally conforms with the inner surfaces of the enclosure walls, and serves to prevent leakage of moisture from the enclosure. If desired, a drain plug may be fashioned in the bottom wall of the enclosure, which opens into the interior of the enclosure through the liner. In this fashion, collected water may be drained from the enclosure as desired.

A pair of adjustable shoulder back straps are also secured to the exterior of the enclosure, allowing the entire cooler to be worn on a person's back.

In preferred embodiments, the cooler is provided with exterior pockets which are adapted to hold various objects. Such pockets can be located anywhere in the cooler and closed by any conventional closure devices including buttons, snaps, buckles, hook and loop fasteners, zippers. Other preferred embodiments will also include a pocket wherein elastic mesh netting or cargo netting is used to secure items between the exterior of the cooler and such netting. In these embodiments, the flexibility and elasticity of the netting provides sufficient bias against items in the pocket so as to secure the items in the pocket without the need for a pocket closing flap.

In use, beverages or food together with a coolant source such as ice may be placed within the enclosure, and the top panel closed. In this condition, the loaded cooler can be worn on a person's back, thereby distributing the load and making it easier to carry the otherwise heavy and burdensome load. As the cooler is worn, access may be had to the interior thereof by opening the top panel. Similarly, when the backpack is removed from the person carrying it, it serves as a regular cooler.

DETAILED DESCRIPTION OF THE PREFERRED EMBODIMENT

Figure 2:
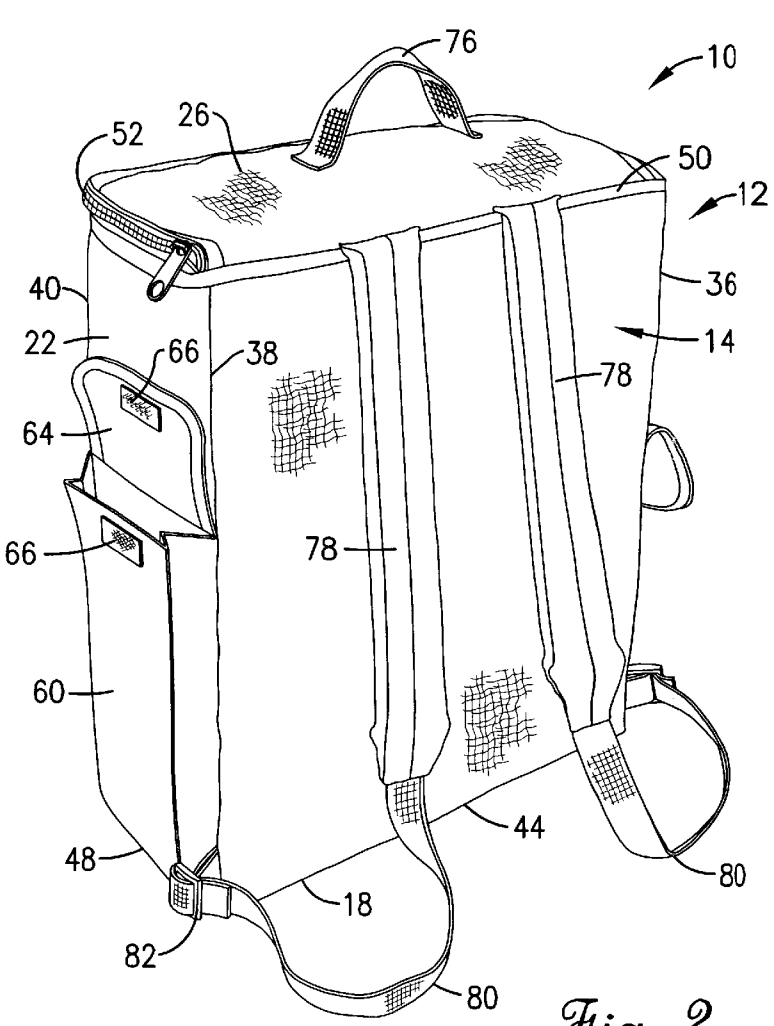
FIG. 2 is a rear perspective view of the backpack cooler, illustrating the backpack shoulder straps and external side pockets.
Figure 1:
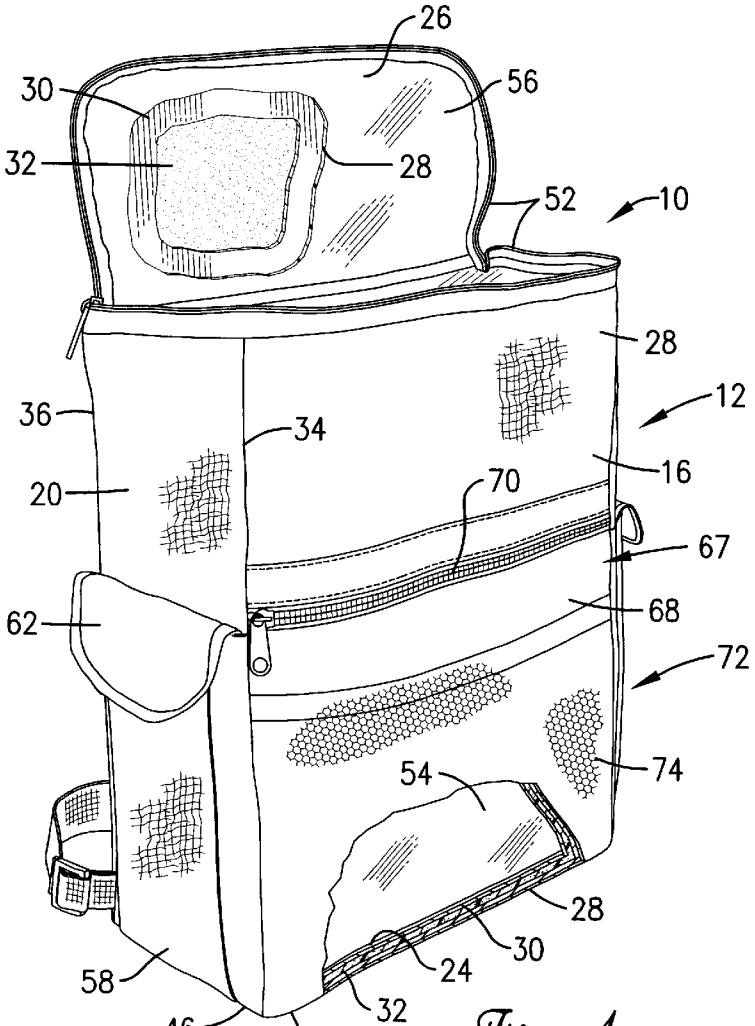
FIG. 1 is a front perspective view of the preferred backpack cooler, showing the top panel open and with parts broken away to illustrate the construction of the cooler.

Turning now to the drawing, a backpack cooler 10 in accordance with the invention includes a flexible enclosure 12 with a pair of spaced, parallel backpack shoulder straps 14 secured thereto. The cooler of the invention is designed to hold and cool food and/or canned or bottled beverages and can be worn on a person's back in the manner of a conventional backpack to aid in the transportation of such beverages.

In more detail, the enclosure 12 is flexible in nature and includes opposed front and rear walls 16, 18 respectively, sidewalls 20, 22, bottom wall 24 and a top panel 26. Each of the walls 16–24 are of layered construction and in preferred forms are identically constructed. Taking for example front wall 16, the wall includes an outermost layer of flexible fabric 28 (preferably a nylon canvas-like material or cordura-like material which may be of any color scheme or decorated with camouflage or other markings) with an inner facing of reflective foil 30. A layer of thermal insulation material 32 is sandwiched between the fabric layer 28 and foil facing 30. Preferred insulation materials include synthetic resins such as vinyl plastic or PVC. Of course, any conventional insulation material could be used. The remaining walls 18–24 and top panel 26 are of the same construction. The respective walls are interconnected by stitching along lines 34–48 as shown, in order to present the upright enclosure 12. Additionally, the top panel 26 is hingedly secured to rear wall 18 along stitch line 50. A zipper 52 is provided about the upper periphery of the walls 16, 20 and 22 for closure of panel 26.

The enclosure 12 is also equipped with a continuous, water impervious liner 54 which is secured by stitching to the upper periphery of the walls 16–22, but is free of connection with bottom wall 24. The liner 54 serves to prevent leakage of moisture from the enclosure 12, and is preferably formed of light-transmitting flexible synthetic resin material, most preferably transparent vinyl plastic. As shown, the liner 52 is of length to extend from the upper margin of the enclosure downwardly into a generally conforming relationship with the interior surfaces of the enclosure 12. In like manner, the inner face of top panel 26 has the same liner material secured thereto, forming a top panel liner 56.

In order to enhance the utility of the cooler 10, a series of external pockets is provided. First, a pair of elongated pockets 58 and 60 are secured to the sidewalls 20 and 22. The pockets are formed of the same fabric material as used for the fabric layer 28, and have a closable top cover 62, 64 with mating Velcro strips 66 used to releasably secure the covers in their closed positions. In addition, a larger pocket

67 is formed by the addition of an extra panel 68 of the fabric 28, stitched to the bottom portion of front wall 16. A zipper 70 is provided to permit closure of this pocket. Finally, a secondary pocket 72 is formed by the addition of a stretch of mesh material 74 stitched to the panel 68. As an alternate carrying means, the top panel 26 has a hand strap 76 sewn to the outer fabric layer thereof.

The straps 14 are sewn to the rear wall 18, along stitch line 50. Each strap includes a padded uppermost segment 78 with a lower web 80 which is stitched to the lines 34 and 38, respectively. An adjustment buckle 82 is provided near the bottom of each strap, in order to allow length adjustment thereof.

We claim:

1. A backpack cooler, comprising:

a flexible enclosure including opposed front and rear walls, a pair of sidewalls, a bottom wall and a top panel being openable to afford access to the enclosure interior, said walls including an outer layer of fabric, an inner facing of reflective foil, and a layer of thermal insulation between said outer fabric layer and foil;

a continuous, water-impervious liner formed of light transmitting material within said enclosure and permanently secured to the top edges of at least certain of said walls, said liner preventing leakage of moisture from the enclosure; and a pair of back straps secured to the enclosure for permitting the enclosure to be worn on a person's back.

2. The backpack cooler of claim 1, said liner being formed of light-transmitting, flexible synthetic resin material.

3. The backpack cooler of claim 2, said material being essentially transparent.

4. The backpack cooler of claim 1, including an exterior pocket secured to at least one of said walls.

5. The backpack cooler of claim 4, there being exterior pockets formed on said front wall and each of said sidewalls.

6. The backpack cooler of claim 1, said panel including an outer flexible layer of fabric, an interfacing of reflective foil, a layer of thermal insulation between said fabric layer and foil, and a water-impervious liner secured to the inner face of the panel.

7. The backpack cooler of claim 1, said panel being hingedly secured to said rear wall, there being a zipper between the free edges of said panel and said walls permitting the panel to be closed to thereby close said enclosure.

8. The backpack cooler of claim 1, including a hand strap secured to the outer surface of said top panel.

9. The backpack cooler of claim 1, each of said back straps being adjustable.

10. The backpack cooler of claim 1, including a stretch of mesh material secured to said front wall to present an exterior pocket.

11. The cooler of claim 1, said liner material being vinyl.

12. The cooler of claim 1, said liner being free of any connection to said bottom wall.

13. The cooler of claim 1, further comprising a drain plug fashioned in the bottom wall of the enclosure, which opens into the interior of the of the enclosure through the liner.

* * * * *